US009975306B2

(12) United States Patent
Sireix

(10) Patent No.: US 9,975,306 B2
(45) Date of Patent: May 22, 2018

(54) METHOD AND MACHINE FOR ASSEMBLING RIGID TUBULAR BODIES MADE FROM A CARDBOARD MATERIAL WITH A SEALING STRUCTURE

(71) Applicant: Guillaume Sireix, Riedisheim (FR)

(72) Inventor: Guillaume Sireix, Riedisheim (FR)

( * ) Notice: Subject to any disclaimer, the term of this patent is extended or adjusted under 35 U.S.C. 154(b) by 973 days.

(21) Appl. No.: 14/091,519

(22) Filed: Nov. 27, 2013

(65) Prior Publication Data

US 2014/0148322 A1 May 29, 2014

(30) Foreign Application Priority Data

Nov. 29, 2012 (FR) ..... 12 61400

(51) Int. Cl.
*B31B 17/00* (2006.01)
*B31B 17/60* (2006.01)
(Continued)

(52) U.S. Cl.
CPC ..... *B31B 17/60* (2013.01); *B31B 50/60* (2017.08); *B31D 1/005* (2013.01); *B31D 1/0018* (2013.01);
(Continued)

(58) Field of Classification Search
CPC .. B31B 1/16; B31B 1/14; B31B 1/005; B31B 17/00; B65B 7/168; B65B 7/28;
(Continued)

(56) References Cited

U.S. PATENT DOCUMENTS 2,423,965 A * 7/1947 Coyle ..... B29C 65/00 156/294
3,194,479 A * 7/1965 Rumberger ..... B65D 5/64 229/123.2
(Continued)

FOREIGN PATENT DOCUMENTS

DE 10201003900 A1 2/2012
DE 102010039000 A1 6/2016
(Continued)

OTHER PUBLICATIONS

Search Report issued by French Patent Office for priority application FR 1261400 dated Jul. 31, 2013.
(Continued)

*Primary Examiner* — Andrew M Tecco
*Assistant Examiner* — Chelsea Stinson
(74) *Attorney, Agent, or Firm* — Haug Partners LLP

(57) ABSTRACT

The invention relates to a method for manufacturing packages comprising a tubular body made from a cardboard material and a sealing structure made from a cardboard material, and machines implementing said method, comprising supplying a sealing unit (2) with preformed tubular bodies, two by two, and with sealing structures in the form of flat portions, two by two, each one comprising a central part with a shape conjugated to the shape of the opening of the tubular bodies, surrounded by a peripheral portion that can be folded down that is sufficient to assemble a sealing structure sealably with the inner side wall of the tubular body, inserting pairs of sealing structures into a forming tool (7), and forming them in a bowl, inserting, placing and sealing bowls in the tubular bodies using said forming tool;

(Continued)

transferring, two by two, the tubular bodies assembled to the sealing structures to a finishing unit (10), if the sealing structure is a lid, precutting (14) the side wall of said tubular body and partially precutting said lid along a peripheral line, at least one finishing operation for the end of the package bearing said sealing structure.

16 Claims, 12 Drawing Sheets

(51) Int. Cl.

| | |
|---|---|
| ***B31D 1/00*** | (2017.01) |
| ***B65B 7/28*** | (2006.01) |
| ***B31B 50/60*** | (2017.01) |
| *B31B 50/30* | (2017.01) |
| *B31B 105/00* | (2017.01) |
| *B31B 50/02* | (2017.01) |
| *B31B 50/44* | (2017.01) |
| *B31B 50/00* | (2017.01) |

(52) U.S. Cl.
CPC ..... *B65B 7/285* (2013.01); *B65B 7/2821* (2013.01); *B31B 50/005* (2017.08); *B31B 50/024* (2017.08); *B31B 50/30* (2017.08); *B31B 50/442* (2017.08); *B31B 2105/00* (2017.08); *B31B 2105/0022* (2017.08)

(58) Field of Classification Search
CPC ..... B65B 7/2864; B65B 7/2885; B65B 7/00; B65B 7/2821; B65B 7/285
USPC ..... 493/56
See application file for complete search history.

(56) References Cited

U.S. PATENT DOCUMENTS 3,460,310 A * 8/1969 Adcock ..... B29C 65/3656 156/275.7
3,466,731 A * 9/1969 Acton ..... B21D 51/46 29/429
3,478,489 A * 11/1969 Meisner ..... B65B 3/06 426/399
3,628,307 A * 12/1971 Croasdale ..... B65B 7/2807 53/299
3,666,088 A * 5/1972 Wingardh ..... B65D 43/022 206/508
3,714,760 A * 2/1973 Roberts et al. ..... B67B 3/24 53/308
3,808,927 A * 5/1974 Neil ..... B29C 51/445 83/228
3,840,966 A * 10/1974 Reid ..... B23P 19/008 29/773
3,862,816 A * 1/1975 Granseus ..... B29C 65/10 425/292
3,938,301 A * 2/1976 Rejsa ..... B65B 61/20 29/773
4,035,987 A * 7/1977 Nakazato ..... B65B 7/167 53/133.3
4,040,561 A * 8/1977 Philippon ..... B65B 7/168 206/217
4,065,909 A * 1/1978 Mueller ..... B65B 7/168 53/129.1
4,317,399 A * 3/1982 Romagnoli ..... B26F 1/40 83/237
4,362,002 A * 12/1982 Rowland ..... B65B 7/164 53/297
4,599,123 A * 7/1986 Christensson ..... B29C 65/3656 156/273.7
4,640,733 A * 2/1987 Bogren ..... B29C 65/02 156/275.1
4,691,500 A * 9/1987 Danforth ..... B65B 7/2878 156/69
4,724,654 A * 2/1988 Dahlin ..... B31B 1/46 29/238
4,816,110 A * 3/1989 Foldesi ..... B65B 7/2807 156/379.8
4,888,935 A * 12/1989 Wythoff ..... B29C 65/18 53/329.3
5,110,041 A * 5/1992 Keeler ..... B29C 65/02 220/265
5,200,587 A * 4/1993 Fang ..... B29C 65/3656 156/274.2
2,716,408 A 10/1996 Sireix
5,566,529 A * 10/1996 Sireix ..... B31B 17/00 53/412
5,584,388 A * 12/1996 Johnson ..... A47G 19/2227 206/19
5,603,203 A * 2/1997 Robache ..... B65B 7/168 53/257
5,606,847 A * 3/1997 Joensson ..... B65B 7/164 53/268
5,623,816 A * 4/1997 Edwards ..... B65B 7/2878 156/358
6,058,682 A * 5/2000 Pajak ..... B65B 7/164 53/329.2
6,073,422 A * 6/2000 Massey ..... B65B 43/54 53/282
6,138,899 A * 10/2000 Grabher ..... B65D 43/022 220/609
6,161,367 A * 12/2000 Walter ..... B65B 7/2807 53/133.3
6,523,330 B1 * 2/2003 Hurd ..... B65B 43/50 53/289
6,722,102 B1 * 4/2004 Pape ..... B29C 65/10 156/309.9
7,234,500 B2 * 6/2007 Gill ..... B26D 7/10 156/264
7,563,339 B2 * 7/2009 Gill ..... B26D 7/10 156/250
8,424,275 B2 * 4/2013 Schneider ..... B65B 7/2878 53/287
8,541,037 B2 * 9/2013 Bell ..... B65B 7/2835 206/219
9,260,209 B2 * 2/2016 Henriksen ..... B65B 7/168
2004/0020171 A1 * 2/2004 Biba ..... B26D 1/045 53/476
2005/0034819 A1 2/2005 Brown et al.

FOREIGN PATENT DOCUMENTS

| | | |
|---|---|---|
| EP | 0 668 151 A | 8/1995 |
| FR | 1 251 086 | 3/1960 |
| FR | 2 006 078 | 12/1969 |
| FR | 2 716 408 A | 8/1995 |
| WO | WO 2005/058704 A1 | 6/2005 |

OTHER PUBLICATIONS

European Search Report issued by European Patent Office for corresponding European application 13 194 547.9. dated Jun. 1, 2016.

* cited by examiner

METHOD AND MACHINE FOR ASSEMBLING RIGID TUBULAR BODIES MADE FROM A CARDBOARD MATERIAL WITH A SEALING STRUCTURE

FIELD OF THE INVENTION

The present invention relates to the field of tubular cardboard packages, comprising a rigid tubular body made from a cardboard material, a bottom and/or a lid also made from a cardboard material, assembled to the tubular body, intended to contain solid products in divided forms, such as powders, grains, granules, fibers, chips, etc. or products in liquid or paste form. The tubular packages in question are both packages with a circular section and tubular packages with a noncircular section, for example packages with a rectangular or oval section.

The term "cardboard package" typically refers to packages whereof 90 to 98 wt % is made up of cellulosic materials. In addition to layers of cellulosic materials, this type of package comprises metal layers or coatings, such as aluminum, or synthetic layers or coatings, associated with the cellulosic materials to form composite surface materials, which here are referred to as "cardboard material". These metal or synthetic materials form, using the generally accepted terminology, a "barrier material" insulating the product stored inside the package from the outside environment, for example to prevent oxidation, drying, or the entry of any pollutants. The synthetic layers or coatings may also play an essential sealing role between two parts of the package during the manufacture thereof; in that case, they are generally referred to as "reactivatable barrier material". In the rest of the text, to simplify the language, the term "sealing" is used to describe the operation causing the permanent or reversible adhesion of two materials of the package, irrespective of the type of the adhesive substance, cold glue, hot glue, hot-melt, fusible coating, etc. used.

The present invention more particularly relates to a method for manufacturing cardboard packages comprising a tubular body made from one or more layers of a cardboard material and a sealing structure, which forms either the lid or the bottom of the package, comprising

- providing sealing structures in the form of flat portions comprising a central part with a shape conjugated the shape of the opening of the tubular bodies, surrounded by a foldable peripheral part sufficient to sealably assemble a sealing structure with the inner side wall of a tubular body,
- inserting sealing structures into a forming tool, forming a bowl, and if necessary, heating the sealing structure,
- inserting, placing and sealing the bowl in the tubular body using said forming tool.

Depending on whether the above sealing structure is a lid or a bottom, this type of package will later receive either a bottom or a lid, respectively, after filling with the product it is intended to contain.

The present invention also relates to a machine for carrying out the above method.

BACKGROUND

The French patent published under no. FR 2,716,408 describes the manufacture of a tubular package of the above type. The sealing structure is formed by a cardboard lid made up of a cellulosic material and a safety membrane made from a cellulosic material coated with a barrier material. These two parts are formed one after the other, in the form of cylindrical bowls, by a shaping punch through an outer die and engaged in one end of the tubular body. The side walls of the two parts are assembled sealably with the inner wall of the tubular body. Then, the wall of the tubular body is precut along a peripheral line situated between the assembly zones of the two parts, so as to allow the cardboard lid to be opened without tearing the safety membrane.

Patent application FR 1,251,086 describes a method and device for manufacturing a package comprising a tubular body made from a cardboard material and a lid, sealably assembled to the tubular body, said method comprising

- the flat assembly of three materials in strips, i.e., a cellulosic material coated with at least one reactivatable barrier material, a laminating piece and a material forming the safety membrane;
- cutting the composite strip formed from the three assembled materials into sealing structures in the form of flat portions comprising a central part with a shape conjugated to the shape of the opening of the tubular bodies, surrounded by a peripheral part that can be folded down that is sufficient to sealably assemble the sealing structure with the inner side wall of the tubular body;
- inserting said sealing structure in a forming, placement and sealing tool, heating and forming a bowl of the sealing structure, inserting and sealing the bowl in the tubular body using said forming, placement and sealing tool;
- precutting the side wall of the tubular body and the membrane along a peripheral line situated above said tongue;
- optionally, a finishing operation, such as hemming.

Patent application US 2005/034819 discloses a machine for manufacturing conical cups, wherein the conical bodies are formed one by one in a first unit, then fed one by one to an assembling plate, whereas the bottoms of the cups are fed two by two to this assembling plate. Thereby, the working rate of the bottom feeding device can be reduced to the half of the rate of the bodies forming unit.

Patent application FR 2 006 078 discloses also a machine for manufacturing conical cups made of a synthetic material, wherein the conical bodies are formed one by one in a first unit, then fed one by one to an assembling plate, the bottoms of the cups being also fed one by one to this assembling plate. The assembled cups are thereafter fed one by one to a finishing station. In an embodiment of this machine the finishing station is equipped with double or treble tools, thereby allowing to reduce the working rate in this finishing station versus the rate of the upstream units.

The machines of the state of the art of cardboard packages using the methods described above work at rhythms of 20-80 units, i.e., tubular bodies+lids, per minute. After adaptation, these machines for forming lids also allow the placement of cardboard bottoms in previously filled boxes. The latter operation is done in the plants consuming said packages.

With the major development of the sales of cardboard boxes of the type described above since 2007 and the pricing-related pressure exerted by the industries consuming these packages, there is a demand to find technical solutions to produce more, faster, and therefore less expensively.

SUMMARY OF THE INVENTION

To that end, the invention proposes a method for manufacturing packages comprising a tubular body made from a cardboard material and a sealing structure, comprising supplying a sealing unit with preformed tubular bodies and sealing structures in the form of flat portions comprising a central part with a shape conjugated to the shape of the opening of the tubular bodies, surrounded by a peripheral portion that can be folded down that is sufficient to assemble a sealing structure sealably with the inner side wall of the tubular body, inserting each sealing structure into a forming tool, and forming it in a bowl, inserting, placing and sealing said bowl in a tubular body using said forming tool;

if the sealing structure is a lid, precutting the side wall of said tubular body and partially precutting said lid along a peripheral line, if the sealing structure is a lid, at least one finishing operation for the end of the package bearing said sealing structure, in which method said tubular bodies are brought to said sealing unit two by two, the sealing structures are brought two by two to pairs of forming tools of said sealing unit to be formed into bowls therein, then inserting two by two, placed and sealed in pairs of tubular bodies by said pairs of forming tools, and the tubular bodies bearing said sealing structures are subjected two by two to subsequent precutting and finishing operations.

According to one embodiment, the method comprises the flat assembly of at least two materials in strips, i.e., a strip of a cellulosic material that can be coated with at least one barrier material and a strip of a material forming a safety membrane, into a composite strip, precutting the composite strip into sealing structures by pairs of flat portions, one of the flat portions of a pair being precut in the left part and the other flat portion of the same pair being precut in the right part of the composite strip.

According to one embodiment, the method follows a pitch by pitch rhythm, and the advancement of the material strips by one pitch, an assembly sequence of the composite strip, and a sequence of cutting two sealing structures in the composite strip are made subject to the insertion of a pair of sealing structures in the forming tool.

According to one embodiment, an assembly sequence of the composite strip comprises creating a relief difference on the strip of cellulosic material between the central zones of a pair of sealing structures and the peripheral zones to be glued, this method step being optional depending on the glues, placing a film of glue on said peripheral zones, putting the strip of the cellulosic material and the membrane strip in contact, pinching the zone to be glued between and using punches locally compressing said strips, applying a pressing tool between said punches.

According to one embodiment, after each time the composite strip advances and before cutting a pair of sealing structures, the skeleton of the composite strip is tensioned by traction means.

According to one embodiment, the flat portion precut in the left part and the flat portion precut in the right part of the composite strip during a same cutting operation are longitudinally offset.

According to one embodiment, the skeleton of the composite strip is separated into its components downstream from said traction means.

The invention also relates to a machine for manufacturing packages comprising a tubular body made from a cardboard material and a sealing structure made from a cardboard material, assembled to the tubular body, said machine comprising a sealing unit comprising a rotating sealing plate, said sealing plate comprising a number N of sealing stations, with $3 \leq N \leq 50$, each sealing station comprising two sealing tools, said sealing plate rotating following a rhythm via an indexer with N stops, a feed device inserting tubular bodies into a first sealing station two by two, an insertion device bringing sealing structures in the form of flat portions, two by two, to a pair of forming tools of the second sealing station upstream from the first sealing station, a device for transferring tubular bodies, sealed to sealing structures, from the sealing plate to a unit arranged downstream.

According to one embodiment, the machine further comprises a finishing unit comprising a rotating finishing plate, said finishing plate comprising a number N of finishing stations arranged each to receive a pair of tubular bodies sealed to sealing structures, said finishing plate rotating following a rhythm via an indexer with N stops, and at least one double finishing tool, with which each finishing station interacts to perform at least one specific finishing operation on each tubular body sealed to a sealing structure, a device for ejecting said packages from the finishing plate.

According to one embodiment of the machine, N=8.

According to one embodiment, the machine may be made with only one sealing unit, if no finishing operations are desired on the box, in particular in the event the method relates to the placement of bottoms on the tubular bodies.

According to one embodiment of the machine, a so-called double finishing tool is a tool for precutting lids.

According to one embodiment of the machine, the finishing unit comprises a double hemming tool.

According to one embodiment of the machine, the finishing unit comprises at least one double stacking tool.

According to one embodiment of the machine, it comprises a unit for making, two by two, sealing structures in the form of flat portions comprising a central part with a shape conjugated to the shape of the opening of the tubular bodies, surrounded by a peripheral part that can be folded down that is sufficient to assemble a sealing structure with the inner side wall of a tubular body, operating following a pitch-by-pitch rhythm, and subject to the insertion of a pair of sealing structures in two forming tools.

According to one embodiment of the machine, said production unit comprises a reel of a strip of a cellulosic material that may be coated with at least one barrier material and a reel of a strip of a material forming a safety membrane, the width of said strips being sufficient to house two sealing structures transversely, optionally, a station for creating raised portions on predetermined zones of the strip of cellulosic materials, based on the type of glue used, a station for gluing the strip of cellulosic materials, a station for putting the membrane strip in contact with and pressing it on the strip of cellulosic materials, a station for precutting sealing structures comprising two cutting tools that are longitudinally offset, and at least one feed strip device synchronizing the advancement of the strip of cellulosic material with the advancement of the strip of membrane material, forming a composite strip, said feed strip device and the aforementioned stations of the production unit being subjugated to said insertion device.

According to one embodiment of the machine, said production unit comprises a removal device for removing the strip skeleton, and in particular a device for separating the strip skeleton into its components.

The invention also relates to:

- a feed strip device for a machine of the aforementioned type comprising two drive rollers with a same diameter and a servomotor driving one of the two rollers, the other roller being driven at a ratio of 1/1 by the first roller.
- a gluing device for a machine of the aforementioned type, comprising a press raising gluing zones two by two, a tray transferring a film of glue from a reservoir onto said gluing zones, a pressing device comprising a set of punches insulating said gluing zones, and a press arranged between said punches.
- a device for inserting sealing structures for a machine of the aforementioned type, having means for adjusting the precutting pitch of the unit for producing sealing structures to the pitch of the forming tools of the sealing station of the sealing unit, comprising a longitudinal linear actuator and two lateral slides.
- a forming tool for a machine of the aforementioned type, comprising a conical pad pressing on the center of a sealing structure to expel the air between the cellulosic material and the membrane material toward the periphery, said conical pad being thermally insulated from the hot part of the forming tool.
- such a forming tool, characterized in that the sealing travel of said tool is adjustable.
- a precutting tool for a machine of the aforementioned type, said sealing structure being the lid, comprising a circular cutting knife and a precutting mandrel housing the tubular body, said knife being arranged relative to the mandrel so as to create an incision in the tubular body below the surface of glue binding the membrane to the cellulosic materials of the lid and so as to pass through all of the layers of the tubular body and the membrane but not the cellulosic material of the lid, the speeds of rotation of the knife and the mandrel being adjusted so as to synchronize the tangential speeds of the knife and the tubular body.
- such a precutting tool, characterized in that the edge of the knife is locally altered to create fastening points or a hinge.
- such a precutting tool, comprising a pre-stressed module pressing on the apex of the packaging.

BRIEF DESCRIPTION OF THE DRAWINGS

Other features and advantages of the invention will appear to one skilled in the art from the description provided below of one embodiment of the machine according to the invention, as well as embodiments of some of its components, in reference to the drawings, in which.

DETAILED DESCRIPTION OF PREFERRED EMBODIMENTS

The embodiment described below is a machine assembling round tubular bodies to round lids to form packages having a safety membrane. One skilled in the art is able to adapt the features thereof to produce embodiments dealing with parallelepiped, oblong, ovoid, or other shaped sections of tubular bodies, as well as embodiments using other types of sealing structures. It may also be observed that the bodies may be handled horizontally or vertically depending on the selected configuration of the machine.

Figure 1:
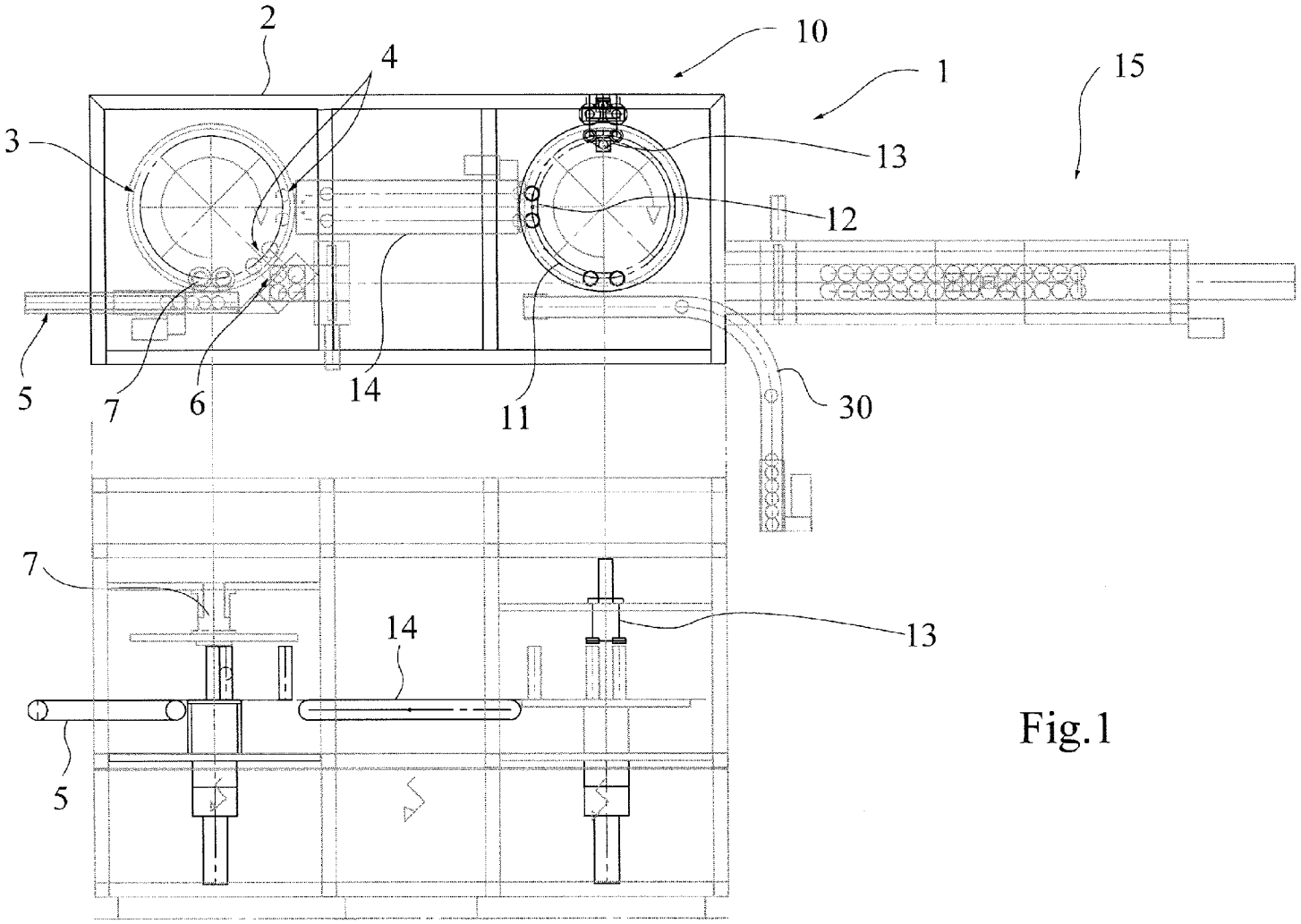
FIG. 1 is a diagrammatic view of an entire machine.

The machine 1 illustrated by FIG. 1 is made up of 3 main units:

The sealing unit 2 seals the sealing structures, i.e., the lids, in rigid tubes arriving in a machine for manufacturing tubular bodies via a feed device 5. The bodies are inserted two by two in a rotating plate 3 with eight stations 4, each station being made up of two forming and sealing tools 7. The bodies are inserted into each tool 7. This plate 3 rotates discontinuously and following a rhythm by means of an indexer with eight stops. The lids, in the form of flat portions cut beforehand from a strip, as described below, are transferred to the sealing tools 7 by an insertion device 6. These lids are then formed through a die 8 creating a vertical skirt, then inserted into a tubular body by a sealing pad 9. The boxes thus obtained, i.e., tubular body+lid, remain in the plate with the heat sealing pad in the lower position during one or more indexing operations of the plate. The pads then leave the boxes and the boxes thus created are ejected from the sealing plate and brought by a transfer device 14 to a finishing unit.

The finishing unit 10 finishes the cardboard lid of the box. The tubular bodies with the sealed sealing structures are inserted into a rotating plate 11 with eight stations 12. This plate rotates discontinuously and following a rhythm via an indexer with eight stops. Each station is made up of two finishing modules 13. The tubular bodies are inserted two by two into each finishing module. During one or more steps of a station 12, the two boxes being finished are presented to a double finishing tool 14 that performs a specific operation on each of the two boxes simultaneously. Up to eight finishing operations are possible, for example precutting to facilitate opening, hemming, or stacking. The boxes are then ejected onto a conveyor 30 two by two. This conveyor leads to placing the boxes on pallets.

Figure 2:
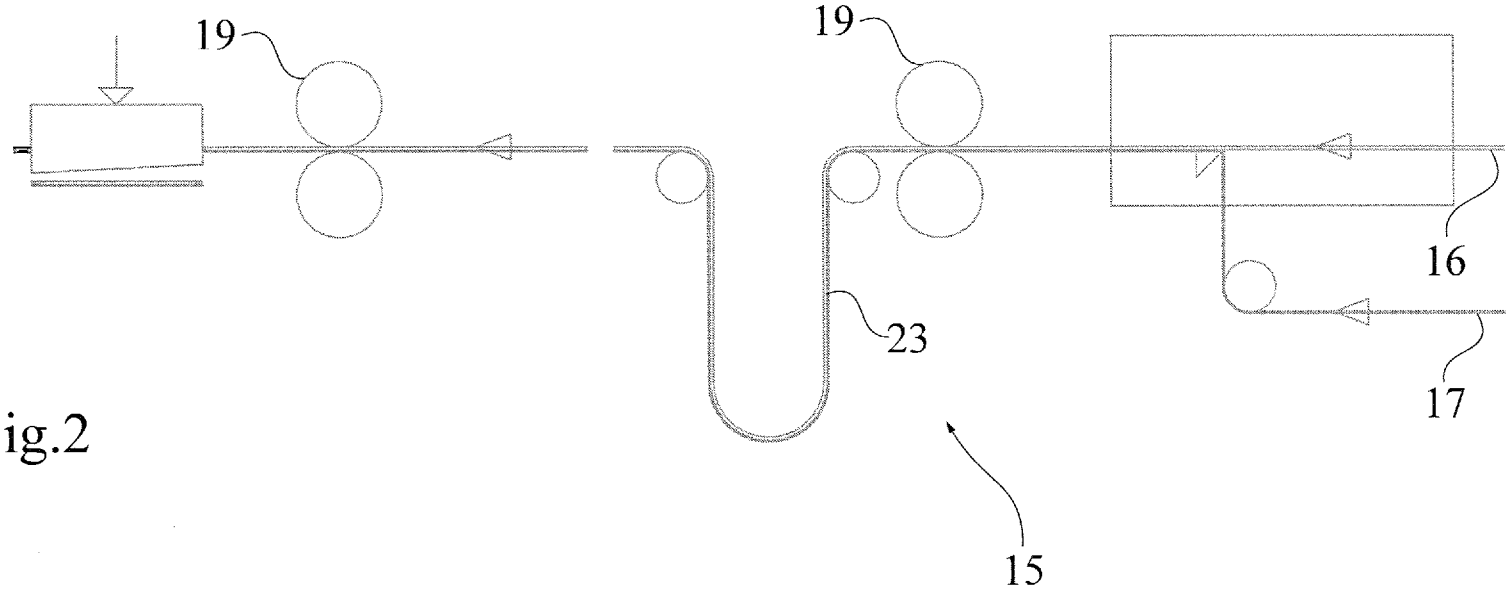
FIG. 2 is a diagrammatic view of a production unit of the machine of FIG. 1.

A production unit 15, illustrated in its entirety by FIG. 2, produces the lids in a flattened state by assembling a strip of cellulosic material 16, in general cardboard, most often but not always printed, and a membrane strip 17, which may have a complex structure. The flat production of the lids two by two is done by using a spool of printed cardboard with two tracks. This leads to cost savings of approximately 10 to 15% in terms of the material for the lids relative to a single printed spool, since the printed parent spools with two tracks are used less for re-cutting.

The printed strip has a constant pitch marked by spots 18, since the printing of the lids is calibrated relative to the spots. This strip is pulled by several feed strip devices 19 with motorized rollers that are controlled by each reading of a spot by a reader 20. This device also pulls the membrane strip 17, which is then synchronized to the advancement of the lid. Each time there is a stoppage, operations are carried out on the strip of cellulosic materials 16, the membrane strip 17 and the composite strip 21, as a result of which they are assembled in an assembly device 22, an embodiment of which is described below. This strip next passes through a cutting station, to be cut into lids therein.

Aside from the cutting of the lids, this production unit may easily perform multiple operations on cardboard or other strips, since they are made flat. It is thus possible to produce cardboard chalking grids from a cardboard membrane, to add printing on both faces of the strip, to position additional components on a lid such as a spout, a plug, etc. Upstream from the assembly, it was possible to perform operations not illustrated in the figures on the membrane strip, which may be a simple or complex film, or a simple or complex cardboard strip. These operations may for example be: cutting and reversal of a tongue; holes, which may or may not be sealed, for a strewing box grid; the addition of a printed document; the placement of a spout or a plastic stopper; etc. Such operations are also possible on the lid strip. The advancement of the two strips being synchronized, the precision of the operations is guaranteed.

One skilled in the art will be interested to learn of particular embodiments of certain steps of the method according to the invention and embodiments of certain workstations of the machine according to the invention, described below.

On-demand Manufacture of Flat Lids.

Figure 3:
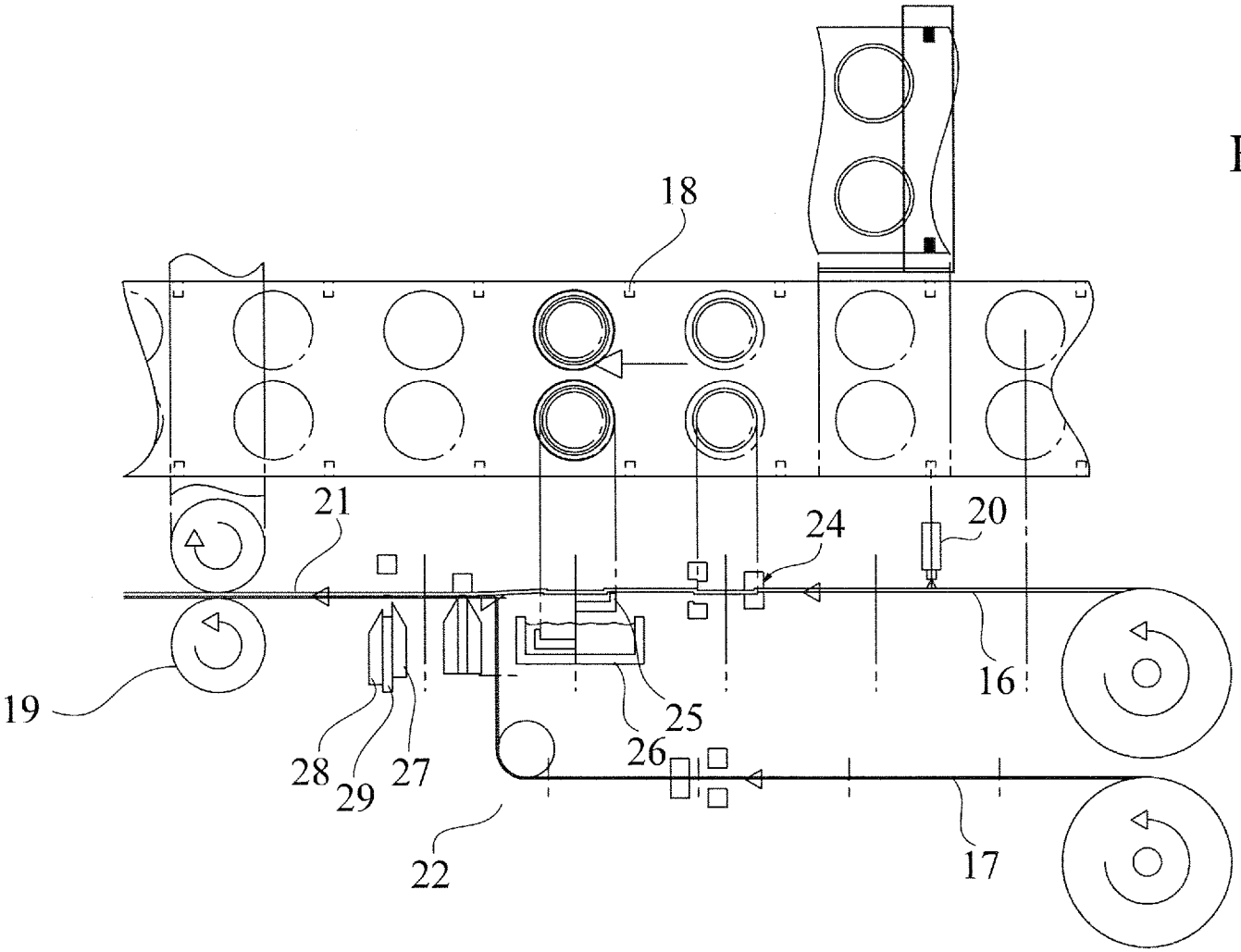
FIG. 3 is a diagrammatic view of the upstream part of the production unit of FIG. 2.
Figure 5:
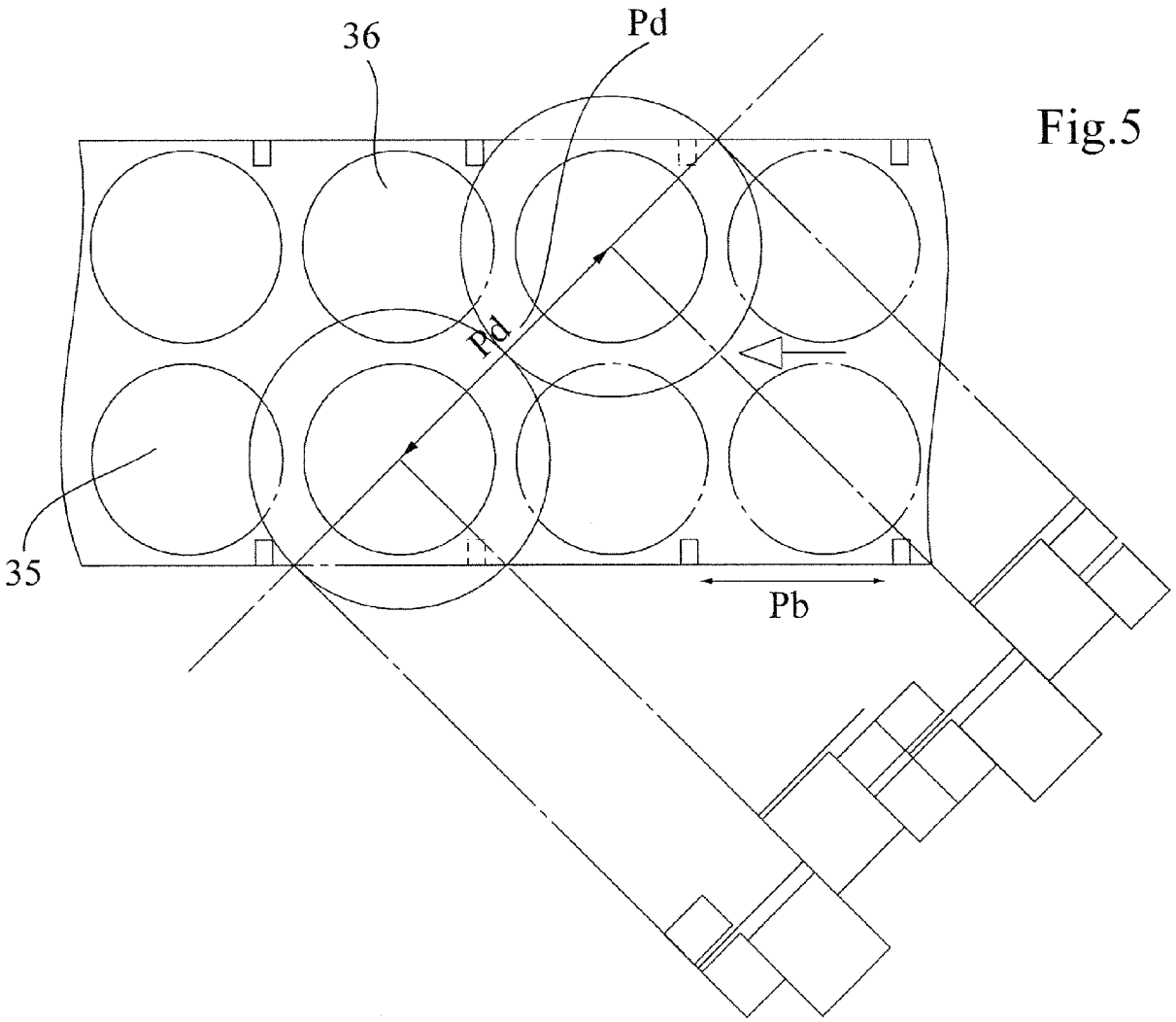
FIGS. 5 and 6 are diagrammatic views illustrating the progression of the strip of the preceding figures at the cutting point of that strip and downstream therefrom.

The assembly of the cardboard strip 16 with the membrane strip 17 by gluing to form a composite strip 21, illustrated by FIGS. 2 and 3, is done discontinuously, but following a pitch-by-pitch rhythm in the upstream zone of the production unit 15. The pitches are determined by printed spots or by the feed strip device itself via an encoder. The cutting of the composite strip into individual lids is illustrated by FIG. 5. The advancement of a lid at a first sealing station 4 creates a request for an assembly sequence of a cardboard strip 16 with a membrane over one pitch. Thus, the time window between the manufacture of the structure of the flat lid and the forming of the lid in the sealing unit can be controlled. This is advantageous for the lid forming/sealing step, since the glue binding the membrane to the lid does not have enough time to dry completely. Thus, during forming of the lid in the sealing tools 7 bringing about the transition from a flat cutout to a lid formed with a vertical skirt, the membrane can slide relative to the lid. This makes it possible on the one hand to eliminate the presence of air between the lid and membrane, and on the other hand to limit the forming strains on the materials. In fact, if there were to be too much air between the lid and the membrane, the temperature of the sealing pads would expand the air present between the lid and membrane such that at the output of the machine, the lid would be inflated and the box not in compliance with the specifications. Limiting the forming strains between the lid and membrane also makes it possible to limit the presence of creases, which could cause a lack of tightness of the sealing and limit the stretching and therefore the embrittlement or even breakage of the complex films of the PE, OPP, PET, aluminum, etc. type forming the barrier of the packaging with respect to moisture and air. Limiting the forming strains also limits the deformation and cutting of any tongue situated on the vertical part of the skirt after forming the lid.

For flexibility reasons, the connection of the assembly device to the cutting station of the lids includes a slack strand 23. The composite strip produced may then be continuous and tensionless between the assembly and the cutout of the lid, and the two stations are mechanically independent.

The control over drying of the glue is verified using several factors, namely: the setting time of the glue, water-based glues having drying times comprised between 20 seconds and 3 minutes; the distance between the lid/membrane gluing station; and the rhythm of the machine. If the machine is stopped for an extended period of time, the lids present between the gluing station and the forming station may be purged automatically or manually.

Furthermore, the composite 21 is manufactured directly on the machine, as a result of which the finished product is not stored, in addition to on-demand consumption, which eliminates waste, and there is no special machine to perform this work; overall, cost savings are procured.

If the distance between the gluing of the lids and the forming of the lids is quite considerable and drying of the glue is inevitable, it is possible to use heat-reversible glues. In that case, the bond between the lid and the membrane will be temporarily limited or reduced by the heat of the forming pad of the lid.

This method for producing lids with two components can also be used to manufacture bottoms. In fact, for economic and/or technical reasons, it may be well advised to laminate the cardboard and barrier/sealing materials for a bottom by using the same method. A bottom may then be created online with various materials. This thereby procures the advantage of limiting the mechanical strains described above to improve the sealing of the boxes.

System for Precision Gluing of the Membrane Strip on the Cardboard Strip.

As shown in FIGS. 2 and 3, the cardboard strip 16 is pulled by a feed strip device 19 with motorized rollers. This device drives both the cardboard strip 16 and the membrane strip 17. The two strips are then synchronized in forward motion. To produce a lid, it is necessary to bind the two strips by gluing.

To apply the glue very precisely and reliably, the embodiment illustrated by FIG. 3 is carried out in several steps.

The first step, which is optional, consists of raising 24 the cardboard strip through a pneumatic, hydraulic or electric press. The central part remains planar, but the glue deposition zone is slightly raised. Thus, when the film of glue is deposited, it is located above the central part. When the lid and membrane will be assembled in advance, the glue will not rub on the membrane and spread toward the center.

A film of glue of from 0.2 to 0.5 mm thick is deposited on the inner part of the lid/cardboard strip opposite the printing by two cavities 25, one for each track of the strip, through a translational movement causing the cavities 25 to go from a tub of glue 26 to being in contact with the cardboard strip. This movement is ensured by a pneumatic, electric or hydraulic cylinder, or by the conversion of a rotational movement, for example link rods/crank. Each cavity then returns to the tub of glue to reload with glue. The shape of the film of glue thus deposited is the same as the cavity. For a round box, the shape of the cavity is a ring with diameters respectively slightly larger than the inner diameter of the box and slightly larger than the cutout diameter of the lid.

The glue must be deposited very precisely. On the one hand so that the membrane and the lid remain perfectly bonded during cutting and on the other hand so that the glue does not disperse toward the inside of the lid. The glue must also be present outside the cutout of the lid to bind the membrane strip to the lid strip of the cutout skeleton, to facilitate the operation of the skeleton removal device. However, while it is essential to have glue outside the cutout, it is also necessary to prevent the glue from dispersing too much toward the outside of the strip. In fact, the width of the strip being optimized to limit costs, the distance between the glue and the ends of the strips is small. If the glue overflows on the flanks of the lid/membrane composite, the elements in contact with the composite can quickly be polluted by the glue (feed strip devices for gluing, cutting, extraction as well as the guide elements, cutting die punch and forming/sealing tool). This would cause production stoppages as well as user complaints.

In the following pitch, the membrane strip comes into contact with the cardboard strip and is bonded to the future lid with the glue by a pressing system. At that time, a lid/membrane composite is created. To bind the composite, i.e., for the membrane and the lid to be sufficiently bonded, it is necessary to exert pressure on the lid over the previously glued zone. To prevent dispersions of glue toward the center of the lid, a very fine punch 27 first insulates the inner part of the lid at a diameter slightly smaller than the diameter of the glue cavity by exerting pressure on the lid and membrane strips. Another punch 28 then plays the same role for the outer part of the lid with a diameter slightly larger than the diameter of the glue cavity. A presser 29 situated between the two punches 27, 28 can next compress the glue to bond the two strips. The glue spreads only between the two punches.

For proper management of the gluing cycle, the gluing must be followed by a forward motion of the strip by one pitch, the presser being arranged one pitch after the deposition of the glue. Thus, each time the glue is deposited on the strip, the membrane and the lid are immediately bonded by the presser. In case of production stoppage, the glue therefore cannot dry on the cardboard strip and thereby make bonding between the lid and the membrane impossible, or add an excess thickness to the lid/membrane composite formed by a film of glue that has not yet been compressed by the presser and is therefore raised. This guarantees on-demand and online production of the lid/membrane sealing structures.

This gluing method is applicable to the production of bottoms. However, in that case, the step for raising the lid is not necessary, since there will not be any a posteriori separation of the complex. In the case where the cardboard part of the bottom is not printed, the feed is no longer stopped by reading a printed spot, but by a pitch-by-pitch feed. A hole is then perforated on the cardboard strip. This hole relates to the positioning of the strip on the production unit relative to the gluing and the other operations. This hole is next used as a spot to control the stoppage of the cutting feed strip device. It is then possible to use non-printed, and therefore less expensive, cardboards while having the function of separating the bottom unit and bottom cutting stations.

Precision Driving Devices for Pitch-by-Pitch Driving of the Strips in the Lid Production Unit, Cutting Out the Lid and Removing the Skeleton.

Figure 4:
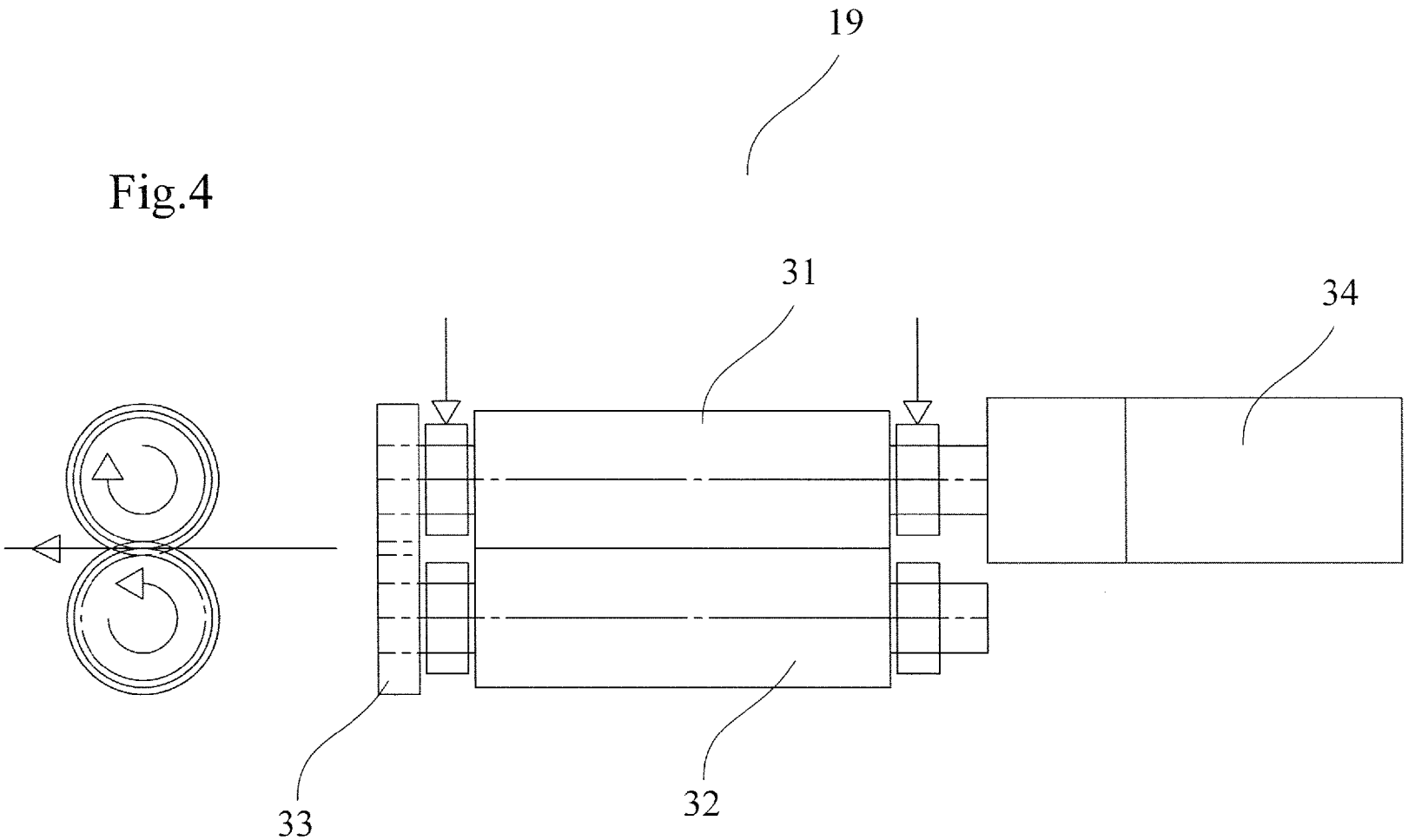
FIG. 4 is a perspective view of a feed strip device.

This strip feed device, illustrated by FIG. 4, uses a mechanism made up of two drive rollers with a same diameter. A servomotor 34 actuates one of the two rollers 31, and the non-motorized roller 32 is driven by the motorized roller 31 by means of a pinion 33 or a belt. The two rollers are then driven in complete synchronization, which improves the precision of each advancement, in particular when the advancement is stopped on the printed spot. This precision allows complete compliance with centering of the strips relative to the spots during the different operations performed on a lid, membrane or bottom.

Offset Cutting of the Lids.

The aim is to use a dual-track printed lid strip that is optimized in terms of width and pitch, thereby limiting the quantity of material not directly used in the manufacturing of the package. This cutting pitch is dictated by an economic variable. In order to optimize the cost of the cardboard strips, and other parts of the composite, the distances between neighboring lids as well as the overall width of the strip must be reduced as much as possible, the surface of the cutting skeleton not being leveraged in the end product. The pitch may also be dictated by the suppliers' printing machines. The offset cutting angle then depends on the pitch of the spots and the width of the strips used. With this cutting method for two lids 35, 36 offset by a pitch Pb of the strip, a cutting pitch Pd of approximately 1.4*Pb is obtained, such that there is more space to place the tools related to the cutting and transfer of the lid.

The cutting tools are known in themselves by those skilled in the art. It will be noted that the die punches of the cutting tools may laterally overhang the composite strip.

Pitch Variation Transfer System for Transferring the Cut Lids Toward the Forming/Sealing Tools.

Once the lids or bottoms are cut, they must be transferred into the sealing tools of the lid (or bottom). However, the pitch of the sealing tools Po is not necessarily the same as the cutting pitch Pd, since for operating flexibility reasons, changes in format (diameter or shape) must be fast and incur a limited tooling cost. The pitch of the tools Po results from optimizing a format panel. This difference between the variable cutting pitch Pd and the constant pitch of the tools Po requires a solution for setting the lids by the transfer system to the pitch Po, once they are cut.

Figure 8:
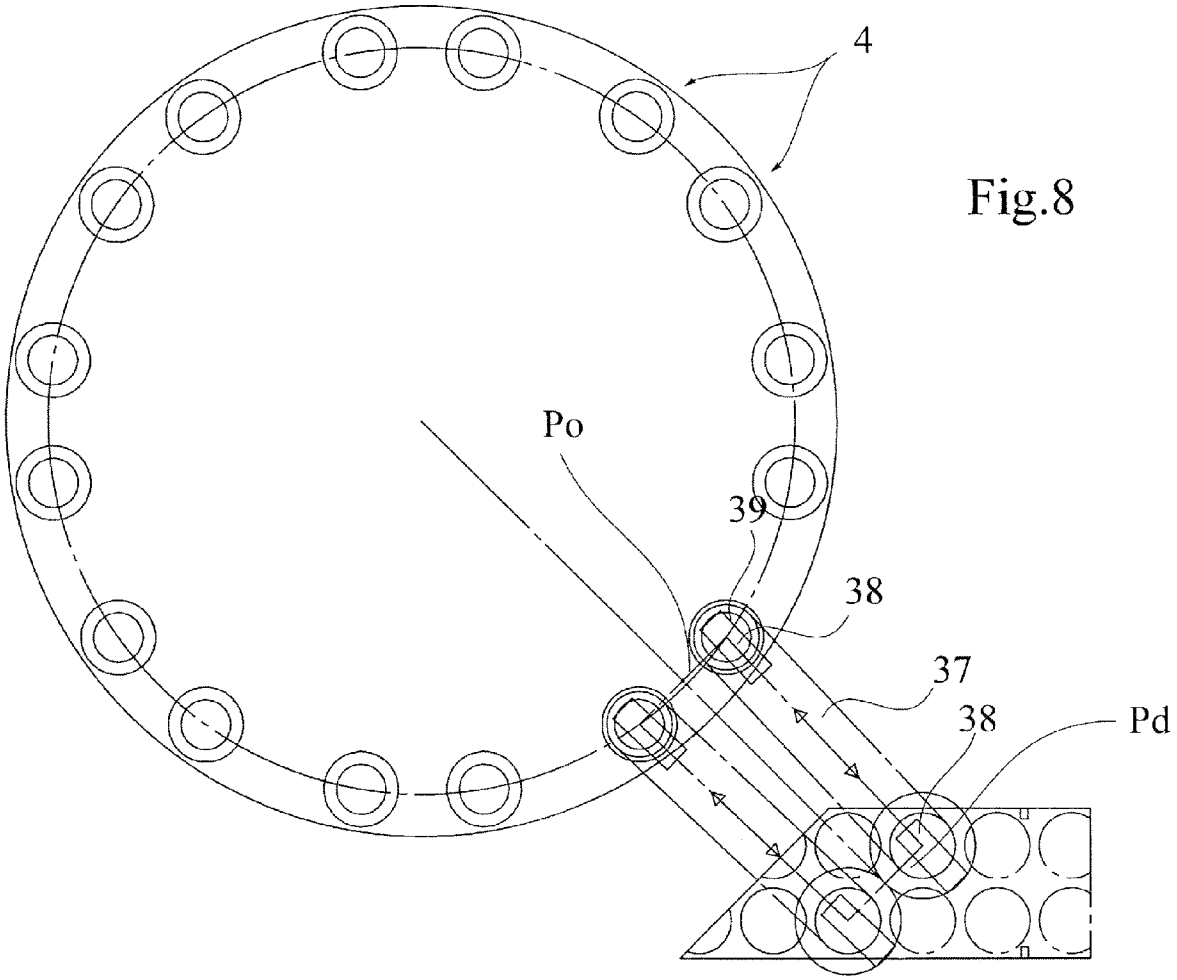
Figure 9:
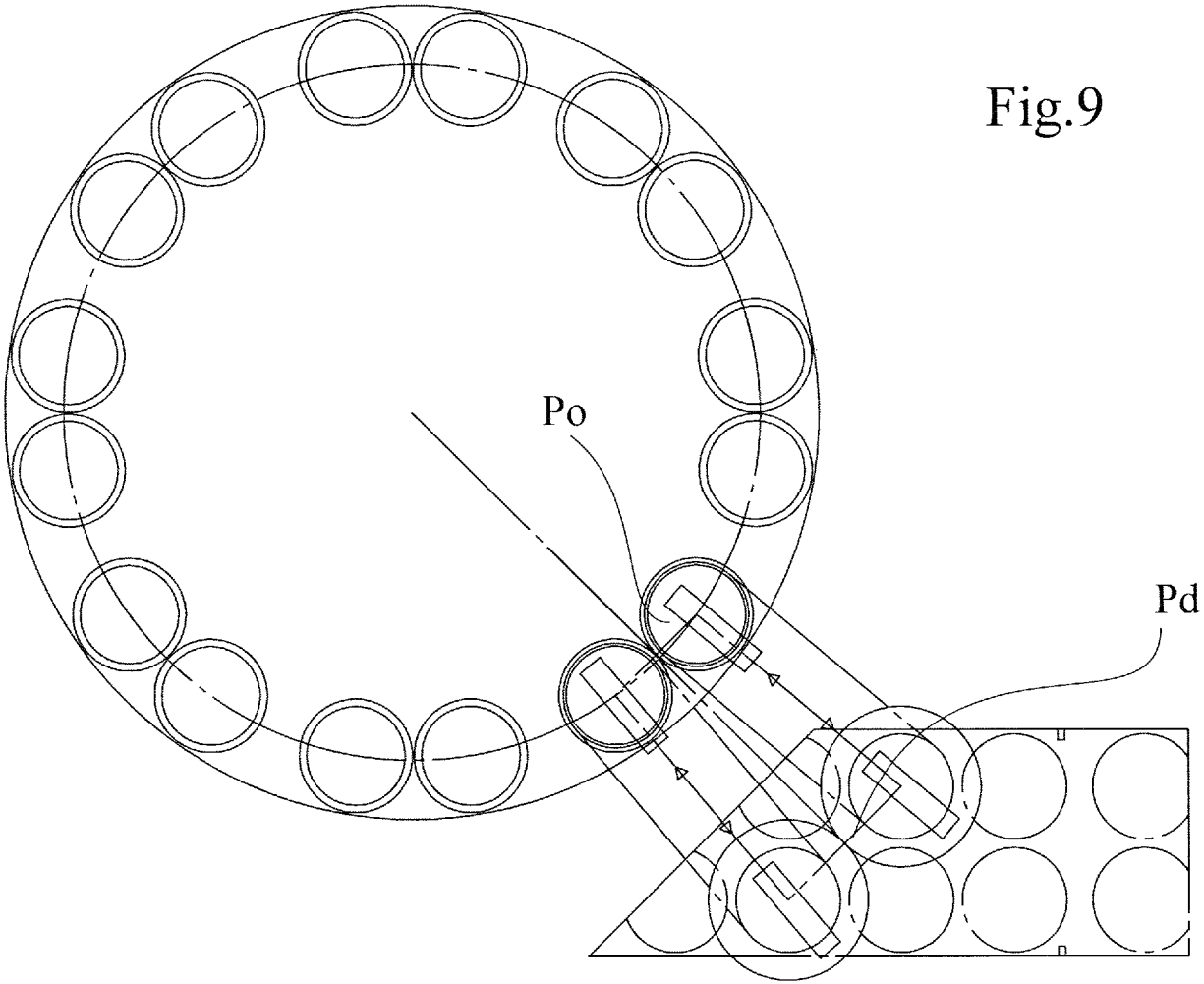

FIGS. 8 and 9 illustrate two cases where Pd<Po and Pd>Po, respectively. The movement of this transfer device is provided by a pneumatic, electric or other linear actuator 37, performing a rectilinear movement. The transfer angle is produced by the movement of the two transfer slides 38, which follow a transverse movement. Thus, in case of format change, it is necessary simply to change the cutting to staggered rows and transferring block with a variable pitch (quick setting), and to change the adjustment variable, and therefore said transfer angle, to the format change. To offset any positioning imprecisions of the lid on the transfer slide, the latter is equipped with a vacuum bar 39. This bar will serve two purposes. The first is to keep the lid on the transfer system, i.e., the slide. The second is to allow the lid the possibility of moving slightly when the lid enters the forming/sealing tools. Thus, the lid may freely center itself in the forming/sealing tool (self-centering).

Example: The machine is optimized to handle boxes with a diameter of 30 to 125 mm as well as other non-round shapes with equivalent perimeters. The cutting pitch is 141.42 mm (2 diameters 90 cutouts), the pitch of the forming/sealing tools of the lid (or bottom) is 132 mm, and the distance between the cutting point and the center of the forming/sealing tool is 200 mm. The transfer device must then have a transfer angle of 2.7° to make that transition.

System for Removing the Cutting Skeleton.

Figure 6:
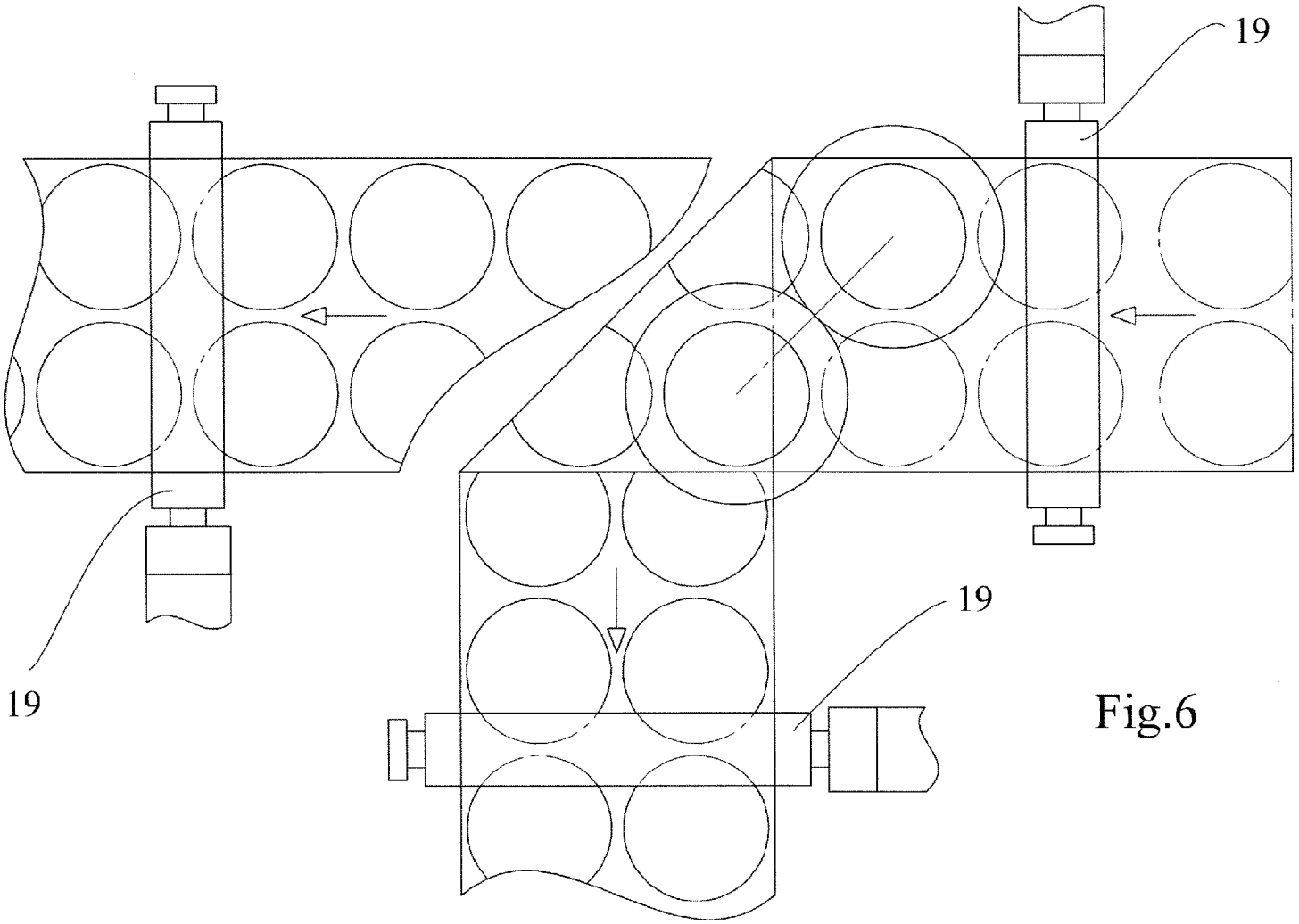

This compact system makes it possible to reliabilize the removal of the strip skeleton by pulling on it with a traction device 19 using rollers as described above, arranged downstream from the cutout, instantaneously reproducing the movement of the feed strip device 19 of the composite strip upstream from the cutout. This makes it possible to remove the skeleton from the cutting station reliably, even if for space reasons, the removal trajectory of the skeleton, two alternatives of which are shown in FIG. 6, is complex, and to improve the positioning precision of the lids, or bottoms, on the cutting station. This improved precision is due to the fact that the strip remains tensioned below the cutting station. This thereby prevents one or more waves from forming in front of the feed strip device upstream from the cutting of the lids, situated relatively far behind the cutting position due to the diagonal cutting system. To ensure sufficient tensioning without breaking the fragile skeleton of the strip, the latter is again tensioned by the feed strip device for extracting the skeleton after performing each feed and before each cutting. This tensioning movement is important, since the overall output between the 2 feed strip devices as well as the travel of the skeleton strip are subject to a variable output, due to the variable coefficient of friction, the machining allowance between the two feed strip devices, etc. This function is performed by a micro-feed calibrated by the extraction servomotor. The stoppage of this micro-feed is controlled by a constant torque or timing.

Device for Separating Layers of the Skeleton

Figure 7:
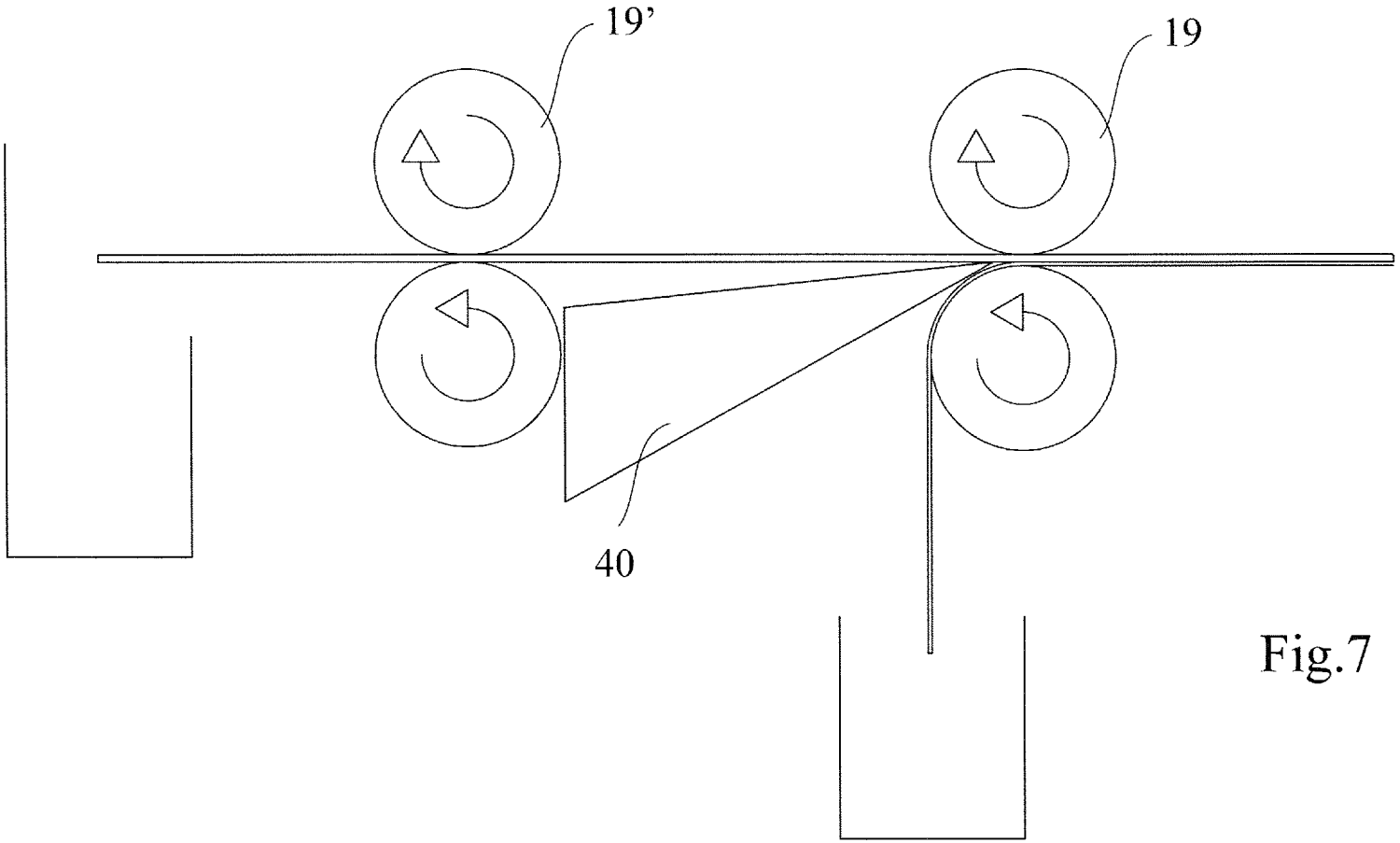
FIG. 7 is a diagrammatic view illustrating the handling of the skeleton of the strip after precutting according to FIG. 6, FIGS. 8 and 9 are diagrammatic views illustrating two configurations of the device for inserting sealing structures into the sealing unit.

The skeleton resulting from the cutting out of the lid is, as previously described, a composite. In certain cases, one or the other part of this composite may be made up of "noble" materials, for example pure cellulose or aluminum. To leverage the waste, it may be profitable to separate the highly usable materials from less usable materials. To that end, the machine may be equipped with a cellulosic material strip/membrane strip separator after extraction. A feed strip device 19' is added after the extraction strip device 19 of the skeleton, operating based on the same principle. A device for separating the strips 40, diagrammatically illustrated in FIG. 7, is placed between these two feed strip devices. Only one of the two strips is pulled by the last feed strip device 19'. The strips are thus separated, the control of the gluing of the lid allowing easy separation. Each element is then recovered in different containers.

Forming/Sealing Pad

Figure 10:
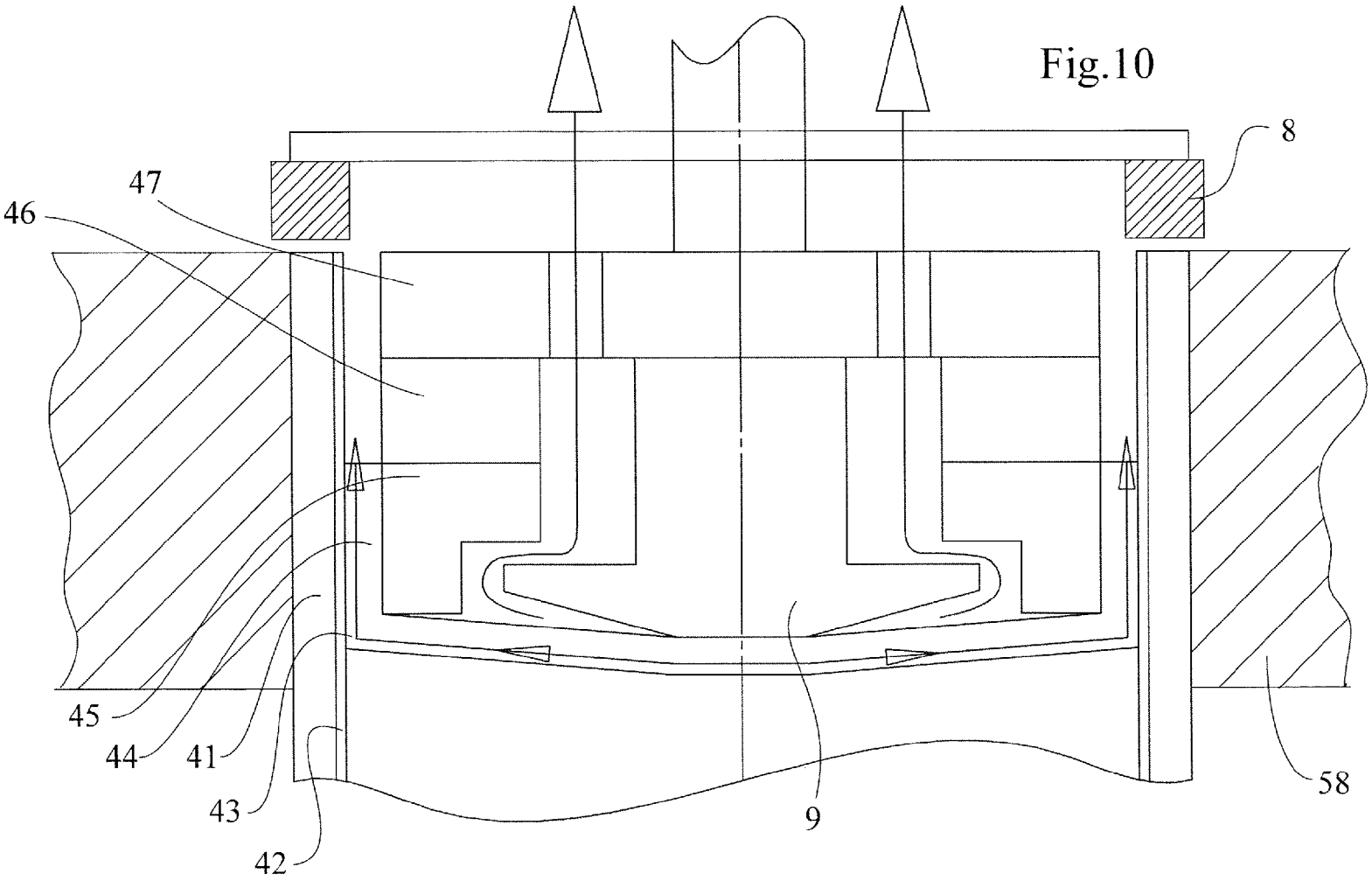
FIG. 10 is a diagrammatic cross-sectional view of the sealing pad.

It is advantageous to evacuate the air located between the layers forming the lid/membrane composite. The forming/sealing pads according to the invention have a design favoring that evacuation, illustrated in FIG. 10. A conical interface 9 makes it possible to create bearing at the center of the cardboard layer 44 of the lid to channel the air flow from the center of the lid toward the skirt, then toward the outside, as shown by the arrows in FIG. 10. The difference between the hot parts and the cold parts of the tool may exceed 50° C. The hot part 45 of the sealing tool is insulated from the conical interface 9 by a suitable assembly thereof on the support 47 of the pad, which in turn is insulated from the hot part 45 by an insulating material 46. The temperature on the bearing interface 9 is then limited, as a result of which the printing of the lid is not altered by the heat (no reactivation of the inks and varnishes). The support 47 of the tool is open-worked to allow the hot air to escape. By increasing the sealing time of the lid (between 1.5 and 20 seconds), it is possible to decrease the sealing temperature. Decreasing the sealing temperature avoids making the barrier films 42 of the tubular body and sealing films 43 of the lid more fragile. Additionally, the cardboard layer 41 of the tubular body and the skirt of the lid being subjected to high pressure by the counter-sealing module 58, the cohesion between the sealing films of the body 42 of the box and the membrane 43 has more time to form homogenously without being deteriorated by high temperatures. The sealing of the boxes and strength of the lid are improved as a result. The air is evacuated not only by the forming of the lid, but also during the static phase of the sealing (pad in the lower position in the lid and lid in its final position in the box). The same method is applicable to the sealing of a simple or composite bottom.

Figure 11:
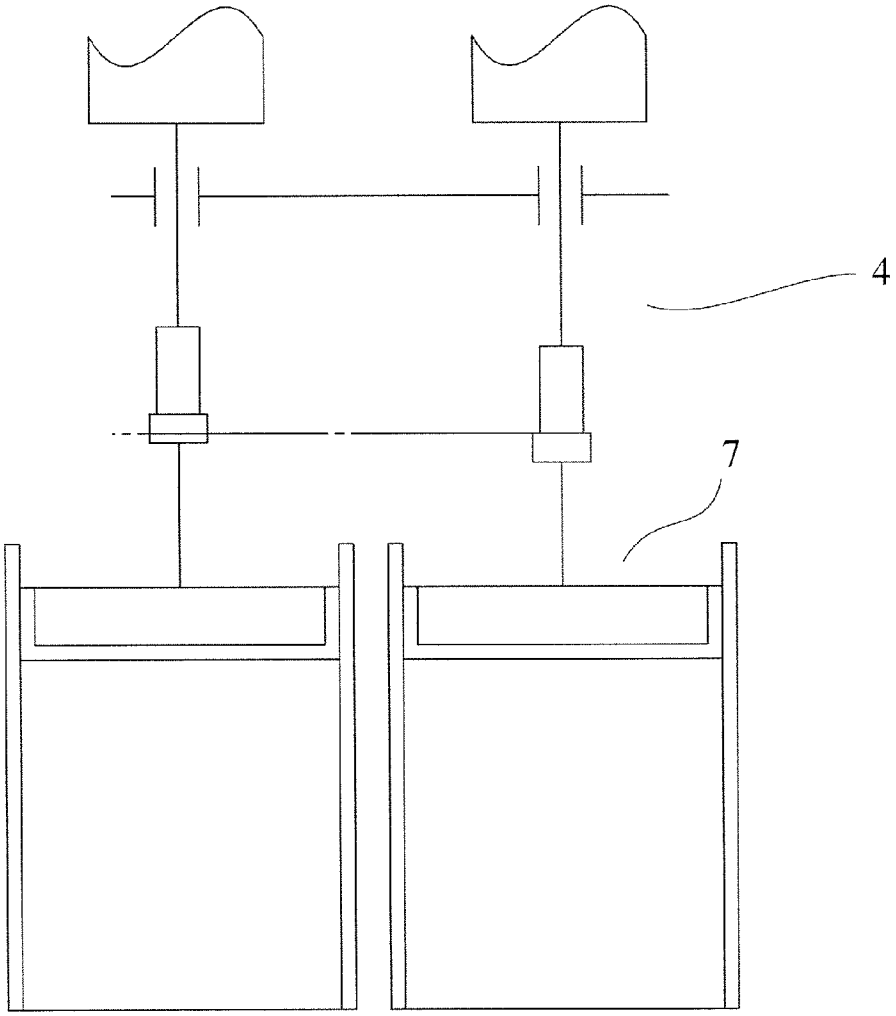
FIG. 11 is a diagrammatic view illustrating the adjustment of the travel of the forming tool.

Variable-travel Device for Forming Lids (FIG. 11).

The precision of the depth of the lids (or bottoms) in a box is key for the compliance of the finished product. The positioning depth of the lids may vary depending on the boxes for different reasons. In order to resolve this problem of adjusting the depth, the machine is equipped with two independent forming/sealing systems 7 with programmable travel for each forming station pair 4. Using the registry of the sealing plate 3, the automaton knows which tool 7 is, at moment t, at the forming/sealing station of the lid. The forming system may be assigned a travel for each tool. This travel may be modified at any time by an operator, after depth verification. The depth may also be adjusted dynamically by measuring the depths of the lids leaving the sealing station. This measurement is done by a suitable sensor, and the lid/tool affiliation is done by the registry of the automaton. The automaton may then give the forming tools the appropriate travels for each tool, within a predetermined allowance threshold.

Precutting Device for the Lids.

Figure 12:
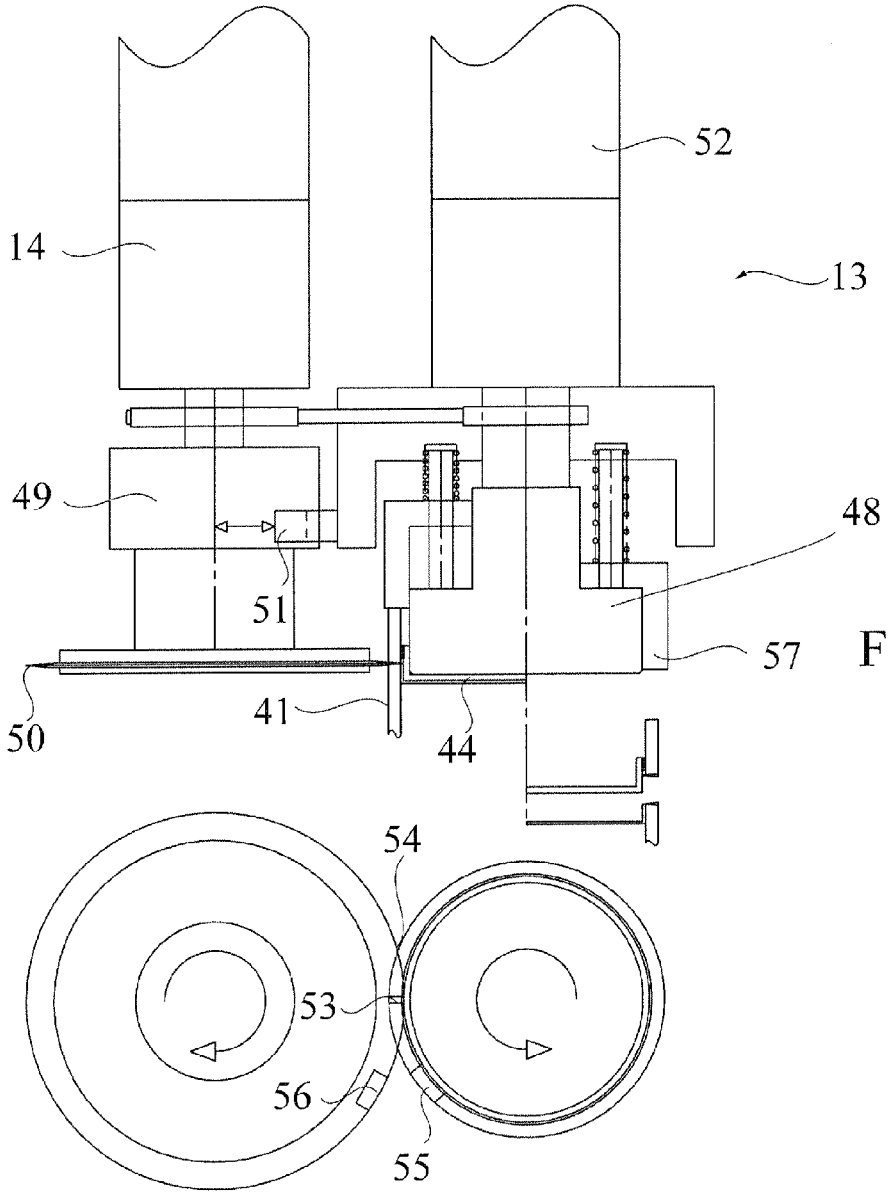
FIG. 12 is a diagrammatic cross-sectional view illustrating a precutting tool.

This device of the finishing unit, one embodiment of which is illustrated by FIG. 12, is used to perform a precise precut on a lid and uses a circular cutting knife. The box enters a mandrel 48 called the precutting mandrel. The knife 50 mounted on a moving support 49 impacts then the box, passing through all of the layers 41, 42 of the body of the box and the membrane 43 of the lid. A stationary stop 51 limits its immersion so that it does not pass through the cardboard layer 44 of the lid. The impact position of the knife is situated on the vertical skirt of the lid/membrane composite and below the glue surface binding the membrane to the lid previously sealed by the sealing unit 2 of the machine. The mandrel 48 next performs a rotation to completely or partially cut out the perimeter of the box. The mandrel 48 and the knife 50 are bonded by a mechanical transmission or a virtual axis. In the first case, a servomotor 52 drives the precutting mandrel; in the second case, an additional servomotor drives the knife. In order to use commercially available standard knives with a standard diameter, a synchronization is established with respect to the tangential speeds between the knife 50 and the body 41 of the box. The synchronization is either obtained by a mechanical transmission, by chain or belt, the speed reducing or increasing ratio of which is the same as the ratio between the diameter of the precutting mandrel 48 and the diameter of the knife 50, or by a rotational interpolation of the two servomotors of the precutting mandrel and the knife, the respective speeds of which are coordinated with the box/knife speed reduction or increase. For example, with a box having a diameter of 100 mm and a knife having a diameter of 100 mm, the ratio is 1; for a precutting mandrel of 50 mm and a knife of 100 mm in diameter, the speed reducing ratio is 2, the box then rotating twice as fast as the knife regarding the number of revolutions per minute.

Along its outer perimeter, the edge of the knife may be deliberately altered by the local removal 53 of the cutting edge, thereby preserving a bond between the lid and the box to create more or less thick fastening points on the box, which then serve as tamper-evident points 54. In that case, the lid will be opened after breaking the fastening points 54. An opening hinge 55 may also be made using the same principle. In that case, the alteration of the cutting edge 56 is greater. The lid then remains connected to the body after opening. It is also possible to obtain a hinge by performing an incomplete cutting of the box by performing less than one revolution with the precutting mandrel.

Because the precision of the precut must be both high, so as not pass through the lid part of the membrane/lid composite, and repetitive, a source sensor is placed on the knife holder. After each cutting cycle, the knife returns to its initial position. Thus, the same part of the knife edge is always used relative to the precutting mandrel. The wear of the knife is then more homogenous and easy to recover by reducing the center distance between the precutting mandrel and the knife when the latter is immersed. Furthermore, using the sensor, the fastening points may always be in the same location relative to the mandrel. In that case, if the boxes are oriented beforehand, during the passage in an earlier workstation, relative to the graphics using a spot printed on the label of the body, it is then possible to place the fastening points, and more particularly the hinge, precisely relative to the opening instructions printed on the body of the box. Another orientation option is to position the lid attached relative to a reference situated on that same lid.

In order to avoid breaking the fastening points due to the pressure exerted by the cone of the cutting knife, a translatable pre-stressing module 57, which is pre-stressed by springs, bears on the apex of the box. This pre-stressing of the box also stabilizes it, preventing the cutting edge of the knife from causing the box to move along the axis of rotation. The junction of the precut is then perfect.

This device, described above for circular boxes, is adaptable for non-round boxes (oval, square, rectangular, etc.). In that case, the immersion stop is no longer stationary, but instead varies based on the shape of the lid. Its position varies by copying a wheel rotating on a cam with a shape homothetic to the cutting mandrel, the wheel being on the referential of the knife holder, or by the movement of an electrical axis interpolated to the shape by programming the latter.

Management of the Defects of the Printed Lids with Auto-Purge of Incorrectly Printed Lids or Lids with a Defect Risk.

If printed lids are used, the stoppages of the feed strips are managed by reading a printed spot relative to each printing of the lid, for example by an optical cell. In certain cases, the spot may be incorrectly printed or deteriorated, thereby making the spot impossible to read. If a feed strip is ruined due to a missing or illegible spot, the lid and membrane strips are then offset relative to the printing, all of the operations done before the junction of the strips are also offset, and the lid resulting from the assembly as well as several subsequent lids are noncompliant. If those same lids are inserted into a box body, the entire box becomes noncompliant; this is a significant risk with respect to the end client.

To offset this risk, the automation of the machine is capable of managing this problem automatically without stopping the line and purging strips, which is costly in terms of time and raw materials, using the following method: the (printing) pitches of the strip are constant, with a certain allowance. This allowance is taken into account to determine the size of the gluing cavity as well as the centering of the printing. If all of the strip stoppages are within the allowance, the lids are considered to be correct. The man-machine interface is used to fill in the printing pitch of the lids, as well as the minimum and maximum allowances of the feed, which may vary depending on the type of operation to be performed on the strips. Upon each feed, the automaton compares the position of the spot relative to the actual feed done. This measurement is performed using the encoder of the feed strip servomotor or an encoding wheel pulled by the strip of the lid. If the spot is detected one printing pitch before the end of the theoretical feed, it is ignored and the feed strip stops at the previously programmed value of the printing pitch. The lid is then positioned within the allowances. If the spot is not detected in its theoretical position, the feed strip stops at the value of the previously programmed printing pitch. The lid is then positioned within the allowances.

The number of advancements done in the pitch measuring mode in case of a noncompliant spot can be programmed by the operator; if that number is exceeded, the noncompliant lids are recorded in a registry, then discharged from the pre-cutting station as follows. The precutting of the lids is stopped, and the feed strip of the lid then advances to remove the noncompliant lids from the cutting system. The risk of a box with noncompliant lids is thereby eliminated. The same method is used for the cutting feed strip of the lid.

In summary, the machine according to the invention is a rapid machine, capable of producing 80 to 200 units per minute of box bodies provided with lids or bottoms with a base of cardboard materials. The main advantage of the machine is that it produces 80 to 85% faster than a machine of the state of the art with comparable operating costs, and with a single machine, therefore fewer mechanical, electrical, electronic and pneumatic elements, than two last-generation machines operating simultaneously. Additionally, using a machine according to the invention in place of two machines of the state of the art makes it possible to save on space, electricity consumption, connected equipment and spare parts; this significantly reduces the production cost of the boxes, and therefore the ultimate cost. Relative to the use of two machines, which requires two agents to check the boxes leaving the machine, the machine according to the invention only requires one person for verification. Production therefore increases by 80 to 85%, but the number of people on the line stays the same.

Considerable space savings are also procured, for example for versions adapted to the placement of cardboard bottoms after filling, which are machines used in the end client's facilities, since clients rarely have space to house several machines on the same production site. In fact, the manufacturing and assembly technology for boxes with lids and bottoms made from cardboard, i.e., eco-friendly and recyclable packages, is more low-key than the traditional technology for composite cardboard boxes, i.e., cardboard body, metal bottom and plastic lid with membrane, which are difficult to recycle. The space savings argument therefore becomes important if the question arises of going from composite box technology to entirely cardboard box technology.

The invention claimed is:

1. A machine for manufacturing packages comprising a tubular body made from a cardboard material and a sealing structure made from a cardboard material, assembled to the tubular body, said machine comprising:

a sealing unit comprising a rotating sealing plate, said sealing plate comprising a number N of sealing stations, with $3 \leq N \leq 50$, each sealing station comprising two sealing tools, said sealing plate rotating following a rhythm via an indexer with N stops, wherein all sealing stations are located on the same plane, a feed device inserting tubular bodies into a first sealing station two by two, an insertion device bringing sealing structures in the form of flat portions, two by two, to a pair of forming tools of the second sealing station upstream from the first sealing station, a device for transferring tubular bodies, sealed to sealing structures, from the sealing plate to a unit arranged downstream, and a device for transferring sealing structures from a cutting station towards a sealing station, said device comprising means for adjusting a precutting pitch (Pd) between two sealing structures of a unit for making sealing structures to a pitch of the forming tools (Po) of the sealing station of the sealing unit, comprising a longitudinal linear actuator configured to perform a rectilinear movement and two transfer slides configured to perform a transverse movement to produce a transfer angle.

2. The machine according to claim 1, further comprising:

a finishing unit comprising:

a rotating finishing plate, said finishing plate comprising a number N of finishing stations arranged each to receive a pair of tubular bodies sealed to sealing structures, said finishing plate rotating following a rhythm via an indexer with N stops, and at least one double finishing tool, with which each finishing station interacts to perform at least one specific finishing operation on each tubular body sealed to a sealing structure, and a device for ejecting said packages from the finishing plate.

3. The machine according to claim 1, wherein N=8.

4. The machine according to claim 2, wherein said double finishing tool is a tool for precutting lids.

5. The machine according to claim 2, wherein the finishing unit comprises a double hemming tool.

6. The machine according to claim 2, wherein the finishing unit comprises at least one double stacking tool.

7. The machine according to claim 1, further comprising the unit for making, two by two, sealing structures in the form of flat portions comprising a central part with a shape conjugated to the shape of the opening of the tubular bodies, surrounded by a peripheral part that can be folded down that is sufficient to assemble a sealing structure with the inner side wall of a tubular body, operating following a pitch-by-pitch rhythm, and subject to the insertion of a pair of sealing structures in two forming tools.

8. The machine according to claim 7, wherein said unit for making further comprises:

a reel of a strip of a cellulosic material that may be coated with at least one barrier material and a reel of a strip of a material forming a safety membrane, the width of said strips being sufficient to house two sealing structures transversely, optionally, a station for creating raised portions on predetermined zones of the strip of cellulosic materials, a station for gluing the strip of cellulosic materials, a station for putting the membrane strip in contact with and pressing it on the strip of cellulosic materials, a station for precutting sealing structures comprising two cutting tools that are longitudinally offset, and at least one feed strip device synchronizing the advancement of the strip of cellulosic material with the advancement of the strip of membrane material, forming a composite strip, said feed strip device and the aforementioned stations of the production unit being subjugated to said insertion device.

9. The machine according to claim 8, wherein said unit for making further comprises:

a removal device for removing a strip skeleton, and in particular a device for separating the strip skeleton into its components.

10. The machine according to claim 1, further comprising:

a feed strip device comprising two drive rollers with a same diameter and a servomotor driving one of the two rollers, the other roller being driven at a ratio of 1/1 by the first roller.

11. The a machine according to claim 1, further comprising:

a gluing device comprising:

a press raising gluing zones two by two, a tray transferring a film of glue from the reservoir onto said gluing zones, a pressing device comprising a set of punches insulating said gluing zones, and a press arranged between said punches.

12. The machine according to claim 1, further comprising:

a forming tool comprising a conical pad pressing on the center of a sealing structure to expel the air between the cellulosic material and the membrane material toward the periphery, said conical pad being thermally insulated from the hot part of the forming tool.

13. The machine according to claim 12, wherein a sealing travel of said forming tool is adjustable.

14. The machine according to claim 8, wherein said sealing structure is a lid, the machine further comprising:

a precutting tool comprising:

a circular cutting knife and a precutting mandrel housing a tubular body, said knife being arranged relative to the mandrel so as to create an incision in the tubular body below the glued surface binding the membrane to the cellulosic materials of the lid and so as to pass entirely through the tubular body and the membrane but not the cellulosic material of the lid, the speeds of rotation of the knife and the mandrel being adjusted so as to synchronize the tangential speeds of the knife and the tubular body.

15. The machine according to claim 14, wherein the edge of the knife is locally altered to create fastening points or a hinge.

16. The machine according to claim 15, further comprising a pre-stressed module pressing on the apex of the packaging.

* * * * *